United States Patent [19]

Fujikawa et al.

[11] Patent Number: 4,762,094

[45] Date of Patent: Aug. 9, 1988

[54] VALVE GEAR FOR FOUR-CYCLE ENGINE

[75] Inventors: Tetsuzo Fujikawa, Kobe; Makizo Hirata; Shinichi Tamba, both of Kakogawa; Yoshiro Yamane, Akashi, all of Japan

[73] Assignee: Kawasaki Jukogyo Kabushiki Kaisha, Kobe, Japan

[21] Appl. No.: 82,286

[22] Filed: Aug. 6, 1987

[30] Foreign Application Priority Data

Aug. 8, 1986 [JP] Japan ..... 61-187092

[51] Int. Cl.[4] ..... F01L 1/04

[52] U.S. Cl. ..... 123/90.6

[58] Field of Search ..... 123/90.6; 74/568

[56] References Cited

U.S. PATENT DOCUMENTS 3,306,276 2/1967 Harkness et al. ..... 123/90.6

4,380,216 4/1983 Kandler ..... 123/90.6

FOREIGN PATENT DOCUMENTS 59-150912 8/1984 Japan .

*Primary Examiner*—E. Rollins Cross

[57] ABSTRACT

A valve gear adapted for a four-cycle engine. Provided are a groove having such a shape folding around a crank shaft with an intersection as to return back to a starting point in two turns, a cam formed on top faces of both banks of aforesaid groove, a tappet arm projecting sideways from a tappet and elastically engaged with aforesaid cam, and a slider supported by aforesaid tappet arm and slidably fitted into aforesaid groove, and aforesaid tappet arm is guided by aforesaid slider to be given a lift by aforesaid cam provided on the outer circumference of the crank shaft.

2 Claims, 2 Drawing Sheets

VALVE GEAR FOR FOUR-CYCLE ENGINE

FIELD OF THE INVENTION AND RELATED ART STATEMENT

This invention relates to a valve gear adapted for a four-cycle engine.

In the well-known valve gear for four-cycle engine, a cam having such a shape folding around a crank shaft with an intersection as to return back to a starting point in two turns is provided on the outer circumference of the crank shaft, to be used for giving a tappet a lift in two turns of the crank shaft to open/close intake and exhaust valves. (e.g. U.S. application Ser. No. 578,631 proposed by the applicant of the invention)

In the valve gear of this type in the prior art, as shown in FIGS. 3 and 4, the cam face 3 has been generally provided by the bottom of the guide groove 2 cut on the outer circumference of the crank shaft 1 and brought into slide contact with the bottom portion A of the slider 6 which is guided by the guide groove 2 to give a valve 4 a lift through tappet 9.

In the cam mechanism of such a construction, it is difficult to improve the roughness of the cam face 3 from a machining technique's viewpoint. Namely, the bottom (the cam face 3) and sides 5 of the groove 2 can be end milled, but cannot be ground after surface heat treatment, which causes the cam face 3 and the slider 6 sliding thereon to have an inferior wear resistance and durability. This affects a lift curve, and finally causes a reduction of engine performance. In addition, the problems causing the reduction of wear resistance are: poor machining which cannot grind the member giving a lift at the bottom (the cam face 3) of the groove 2 as shown in the figure, and a possible chance that the cam face 3 and the slider 6 come into point contact with each other at the slide contact portion A by the slider 6 travelling in the groove 2 slant to the center line of the crank shaft 1. On the other hand, in FIGS. 3 and 4, the slider 6 is integrally provided with a vertical pivot shaft 8 across a step 7, and the pivot shaft 8 rotatably fits into a hole 11 of a tappet arm 10 projecting sideways from the lower end of the tappet 9. The bottom of the tappet arm 10 is pressed down against the step 7 by the elastic force of a compression spring 12, thus resulting in the contact portion A of the lower face of the slider 6 and the cam face 3 subjected to a load from the valve system (such as the elastic force of the spring 12). The valve 4 is provided at the lower portion thereof with a spring seat 13 which is elastically forced downward by the spring 12, thus pressing the bottom end of the valve 4 against the top of the tappet 9. Numerals 14 and 15 respectively designate a cylinder head or crankcase and an intake or exhaust passage.

OBJECT AND SUMMARY OF THE INVENTION

It is the object of the invention to provide a valve gear in which a cam face can be ground to have an enhanced surface roughness with improved wear resistance. It is also a part of the object of the invention to improve the wear resistance of a valve gear to the level of the common four-cycle engine with cam gear and cam shaft by way of linear contact maintained between a tappet arm and a cam face obtained by providing on the circumference of the crank shaft a cam whose surface can be ground, and by keeping the tappet arm into smooth contact with the ground cam face.

To achieve the aforesaid object, a valve gear for a four-cycle engine according to the invention comprises a groove having such a shape folding around a crank shaft with an intersection as to return back to a starting point in two turns, a cam formed on top faces of both banks of the aforesaid groove, a tappet arm projecting sideways from a tappet and elastically engaged with the aforesaid cam, and a slider supported by the aforesaid tappet arm and slidably fitted into the aforesaid groove, and the aforesaid tappet arm guided by the aforesaid slider to be given a lift by the aforesaid cam provided on the outer circumference of the crank shaft.

BRIEF DESCRIPTION OF THE DRAWINGS

In the accompanying drawings, there are shown illustrative embodiments of the invention from which these and other of the objectives, novel features and advantages will be readily apparent.

In the drawings.

DETAILED DESCRIPTION OF THE PREFERRED EMBODIMENTS

Figure 1:
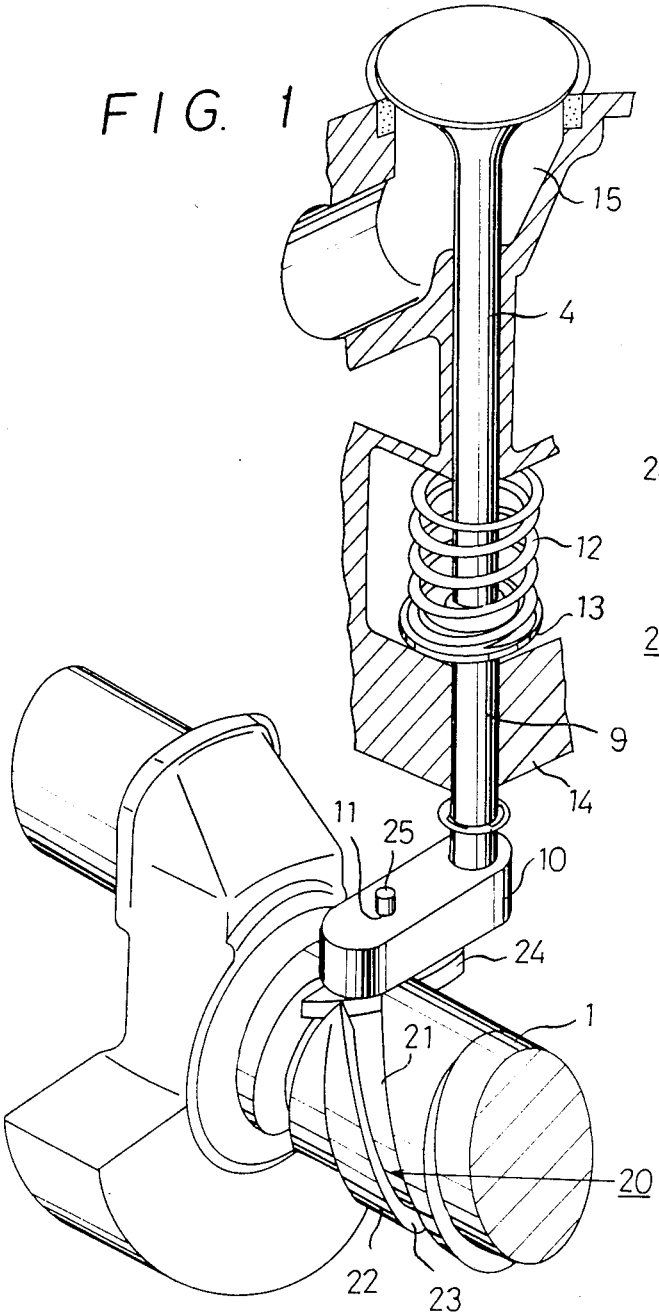
FIG. 1 is a fragmental vertical perspective view of a valve gear according to the invention.
Figure 2:
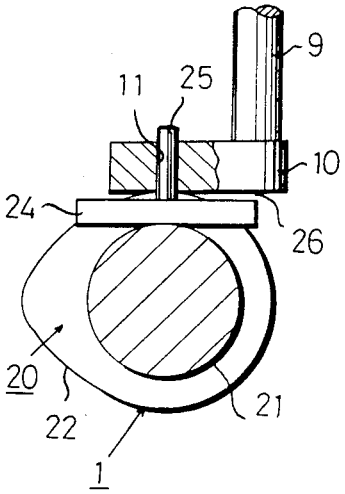
FIG. 2 is a sectional view of the major parts in FIG. 1.
Figure 3:
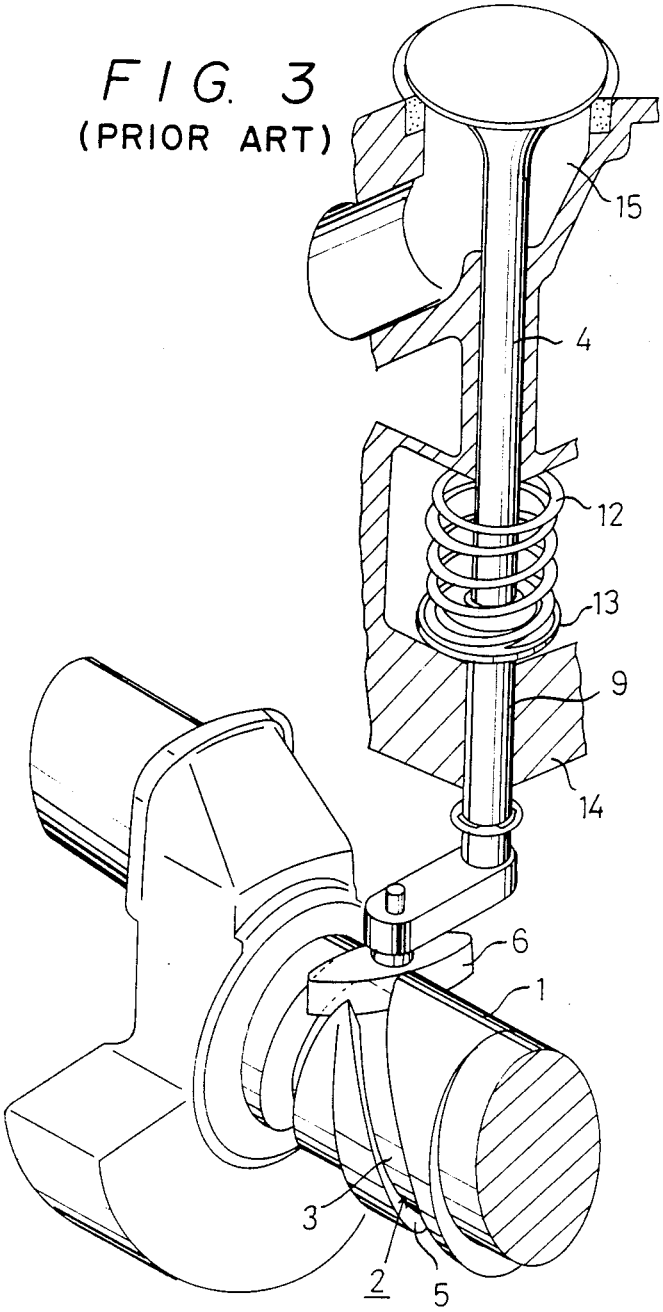
FIG. 3 (PRIOR ART)
FIG. 3 is a fragmental vertical perspective view of a valve gear in the prior art.
Figure 4:
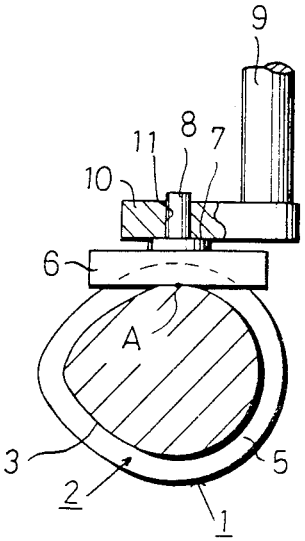
FIG. 4 (PRIOR ART)
FIG. 4 is a sectional view of the major parts in FIG. 3.

In FIGS. 1 and 2, the embodiment according to the invention is shown, and the like reference numerals are provided for the corresponding parts to those for the prior art depicted in FIGS. 3 and 4.

In FIG. 1, a groove 20 has such a shape folding around a crank shaft 1 with an intersection as to return back to a starting point in two turns, similar to those in the prior art, but a bottom 21 of the groove 20 does not work as a cam face: a cam face 22 is formed on the top surface of the inner banks of the groove 20. Therefore, the bottom 21 and bank sides 23 may be machined with end mills for such a constant depth as in the prior art, or for different depths at the different points on the circumference, as shown in FIG. 2. The cam face 22 on the outer circumference of the crank shaft can be ground with high accuracy even after surface heat treatment. A slider 24 may be machined into the conventional boat shape. A pivot shaft 25 of a constant diameter integrally projects from the body of the slider 24 parallel (vertical) to a tappet 9, and slidably and rotatably fits into a hole 11 in a tappet arm 10. The tappet arm 10 is elastically pressed on the cam face 22 at the bottom thereof, by being forced by a spring 12. The slider 24 is so fitted into the groove 20 as to come into slight contact with the bottom 21 due to its own weight, and formed slightly smaller in height than the groove 20 so as to have a gap 26 between the tappet arm 10 and the slider 24 over the travelling range.

While the crank shaft 1 turns twice, the slider 24 circulates in the groove 20 of the cross loop to give a lift by the cam face 22: the cam face 22 gives a lift directly to the tappet arm 10 to open/close a valve 4. In the meantime, the slider 24 simply fits into the groove 20 to guide the tappet arm 10, therefore giving no lift to the tappet arm 10.

According to the invention, the cam face 22 can be ground, to enhance the surface roughness, thus resulting in improved wear resistance with the tappet arm 10 elastically pressed down against the cam face 22. Since the linear contact between the cam face 22 and the tappet arm 10 is always maintained, wear resistance can be improved to such a level as the common four-cycle engine with cam gear and cam shaft.

It will be obvious to those skilled in the art that various changes may be made to the invention without departing from the spirit and scope thereof and therefore the invention is not limited by that which is shown in the drawings and described in the specifications but only as indicated in the appended claims.

What is claimed is:

1. A valve gear for a four-cycle engine comprising:

a groove having such a shape folding around a crank shaft with an intersection as to return back to a starting point in two turns, a cam formed on top faces of both banks of the aforesaid groove, a tappet arm projecting sideways from a tappet and elastically engaged with said cam, and a slider supported by said tappet arm and slidably fitted into the aforesaid groove, and said tappet arm guided by the aforesaid slider to be given a lift by said cam provided on the outer circumference of the crank shaft.

2. A valve gear adapted for a four-cycle engine as claimed in claim 1, wherein said tappet arm is provided with a bearing hole parallel to said tappet at the end thereof, and a pivot shaft integral with said slider is slidably and rotatably fitted into said bearing hole.

* * * * *